United States Patent [19]

Kurihara

[11] 4,198,763

[45] Apr. 22, 1980

[54] DRYING METHOD AND APPARATUS

[75] Inventor: Kouzi Kurihara, Fukuyama, Japan

[73] Assignee: Kitagawa Iron Works Co., Ltd., Japan

[21] Appl. No.: 879,523

[22] Filed: Feb. 21, 1978

[30] Foreign Application Priority Data

Feb. 19, 1977 [JP] Japan ..... 52-17618

[51] Int. Cl.[2] ..... F26B 5/04

[52] U.S. Cl. ..... 34/16.5; 34/92

[58] Field of Search ..... 34/13.4, 13.8, 16.5, 34/92

[56] References Cited

U.S. PATENT DOCUMENTS

| | | | |
|---|---|---|---|
| 1,048,102 | 12/1912 | Sampson | 34/16.5 X |
| 2,073,423 | 3/1937 | Lacasse | 34/92 |
| 3,430,357 | 3/1969 | Perry | 34/16.5 |
| 4,027,401 | 6/1977 | Fairbanks, Jr. | 34/16.5 |
| 4,058,906 | 11/1977 | Pagnozzi | 34/16.5 |

*Primary Examiner*—John J. Camby

*Attorney, Agent, or Firm*—William A. Drucker

[57] ABSTRACT

The invention provides a chamber, or tank, sealable by closing its cover and in which green lumber, agricultural products and/or earthenware to be dried can be artificially dried to the desired degree, or in which they can be provided with insect-proofing and/or rot-proofing treatment or coloring treatment as well as said drying treatment.

The chamber has means for measuring the degree of drying or moisture content of the material to be dried, and means to heat, moisten or dampen the inside of the chamber and to reduce the inside pressure of the chamber.

Such processes (drying, moisturizing and pressure reduction) are carried out in several steps, thereby changing the atmospheric conditions in the chamber in phased programs. This control is performed by checking the drying condition of the material as it is in the chamber. Moreover, unmanned operation is thereby easily secured by converting the drying condition to electrical signals and automatically setting the running conditions with those signals as input.

9 Claims, 14 Drawing Figures

DRYING METHOD AND APPARATUS

BACKGROUND OF THE INVENTION

The main material to be dried in the chamber disclosed by the present invention is lumber. The following description is made with lumber as the example.

In the past, green lumber had been naturally seasoned in the open air in almost all cases. However, artificial drying methods have recently been made more widely known. There are many methods for artificially drying lumber to the desired degree of moisture content. However, the most basic method for said artificial drying is to heap or place lumber in a pile in a drying tank, and to expose said lumber to hot air for drying for a certain given time.

In the prior art, lumber to be dried is accommodated in a pressure-resisting tank whose pressure is raised to 1 to 18 times atmospheric pressure, and is simultaneously exposed to a vapor jet for 1 to 3 hours. The inside pressure of said tank is reduced to 600 mmHg, thereby reducing moisture. The lumber so treated is placed in a pile in a sealed chamber and hot air having a temperature of approx. 45° C. is applied by a blower to said lumber in an airflow in the chamber. Said hot air is circulated, thereby reducing the moisture content of the lumber to less than 10%. This drying method has been disclosed in Japanese Pat. Publication No. 33001/1973.

Recently, a vacuum drying method, by which a sealable chamber is prepared and lumber is dried with the inside pressure of said chamber reduced, has been proposed, thereby greatly shortening the drying time. However, the control of this method such as the temperature, the humidity and moisture and/or pressure reducing is not automatic but is by human operation and depending upon skill from long experience.

Therefore, the control of temperature, humidity and/or pressure reduction in this method is not always suitable for drying lumber, thereby causing such defects as surface hardening, drying unevenness, and surface/inside cracks or splitting.

OBJECTS OF THE INVENTION

An object of the present invention is to provide an improved method for drying lumber and an apparatus which is so designed that the optimum temperature, humidity and pressure reduction may be adequately set according to the drying degree (moisture content) of lumber placed in a sealed chamber during drying by sensing the drying degree (moisture content) of said lumber as it is in said sealed chamber, that said apparatus may be run at completely optimum conditions till the desired drying degree (moisture content) is obtained, and that said apparatus may be cheap in its running cost and free from any unevenness in hot air circulation rate, temperature and vacuum during drying operations.

A further object of the present invention is to provide an efficient and economical method and apparatus that can carry out or accomplish insect-proofing, rot-proofing, coloring and other necessary treatments, which had been conventionally performed in a separate vessel or tank other than the drying chamber, in the same chamber simultaneously during the above drying process or just after the above drying process is completed.

These and other objects of the present invention will be made clearer by the following detailed description of preferred embodiments of the present invention.

BRIEF DESCRIPTION OF THE DRAWINGS

In the drawings:

FIG. 8A being a side view and FIG. 8B being a front view;

DESCRIPTION OF THE PREFERRED EMBODIMENTS

Figure 1:
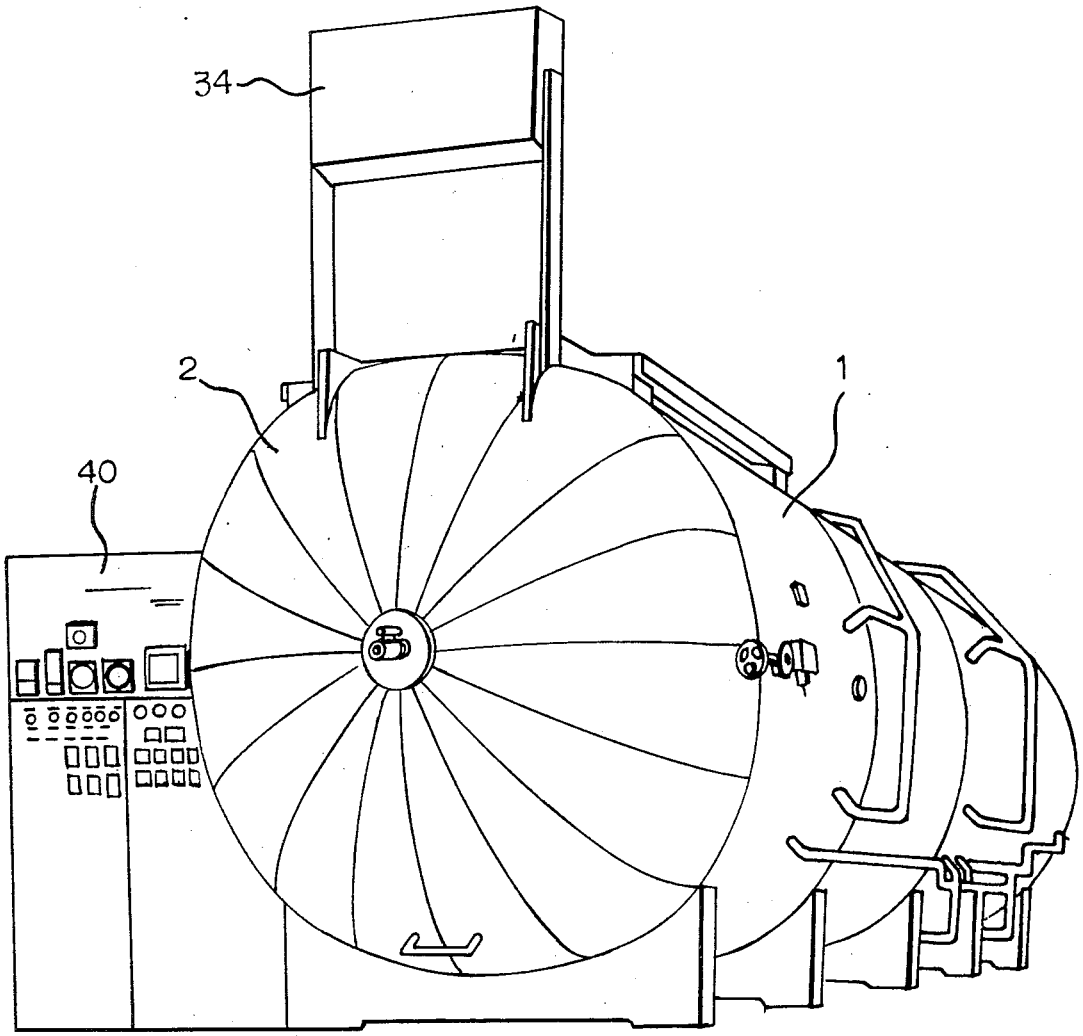
FIG. 1 is a perspective view of the whole system disclosed by the present invention.
Figure 2:
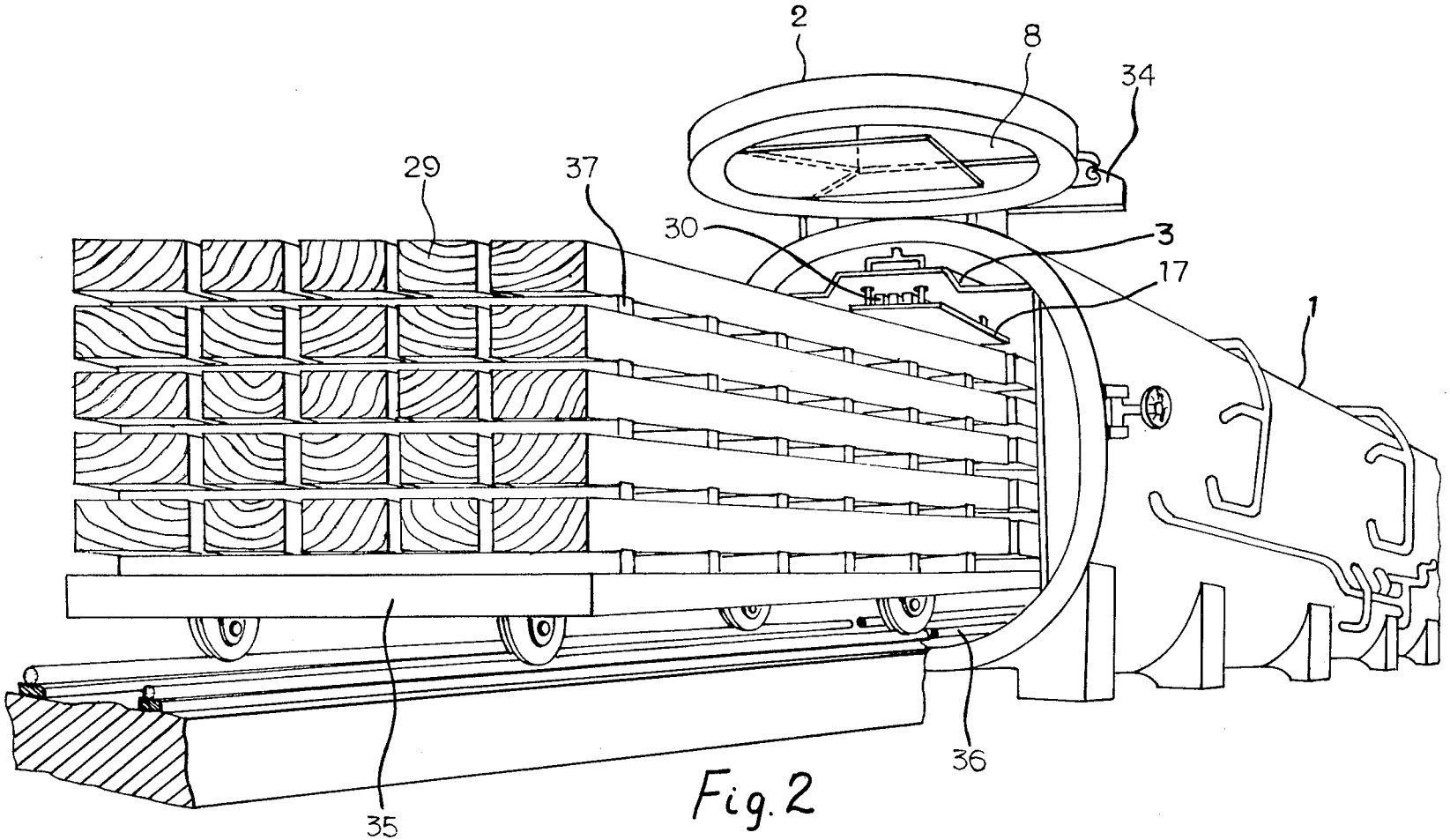
FIG. 2 is a perspective view illustrating the sending of green lumber into a drying chamber disclosed by the present invention.

Referring to the drawings, 1 is a chamber body, one end of which is open and the other end of which is closed, having a fixed capacity in the longitudinal direction. The shape is not limited to that of the embodiment shown in FIG. 1 but may be rhombic or elliptical. 2 is a door for insertion and removal of the material to be dried or treated, which is mounted at said open end of said chamber 1 so that it may seal said chamber when it is closed. A partition plate 3, which partitions the inside space of said chamber 1 in the longitudinal direction, so that an upper-partitioned space may be made small and a lower-partitioned space may be made much greater than the upper space, is mounted in said chamber 1. The end of said partition plate 3, which is provided at the closed side of said chamber 1, is V-shaped, thereby forming compartments A and B. A blower 4 is mounted at the closed side of said chamber 1. Air coming out of said blower 4 is directed so that it may spread outwards from the window 6 of a partition plate 5 and be introduced by a guide plate 7 mounted on the inner wall surface of said chamber. Then, said air is divided by said partition plate into two streams, upwards and downwards, in said chamber body 1 and flows toward said door 2 as shown by the arrows a and b in FIG. 3.

Figure 3:
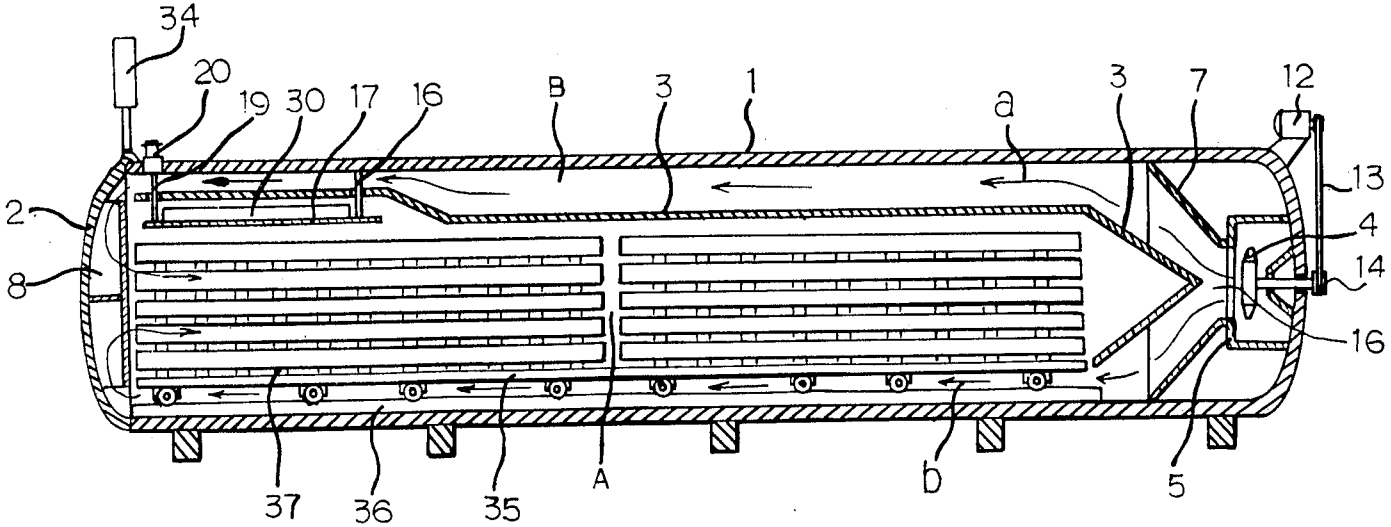
FIG. 3 is a semi-diagrammatical vertical sectional view of said drying chamber.
Figure 4:
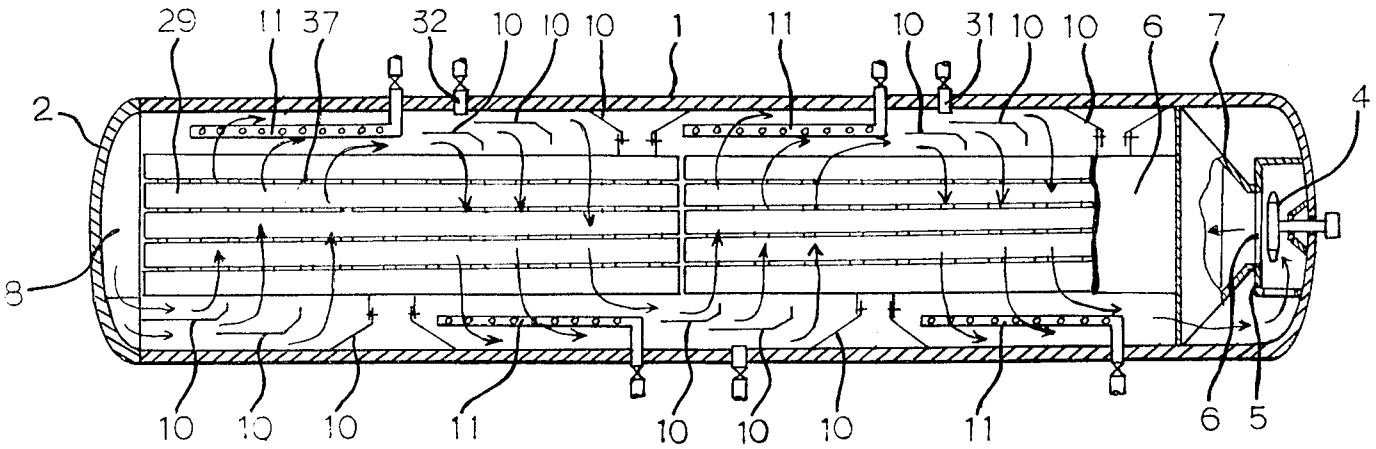
FIG. 4 is a semi-diagrammatical horizontal sectional view of said drying chamber.
Figure 5:
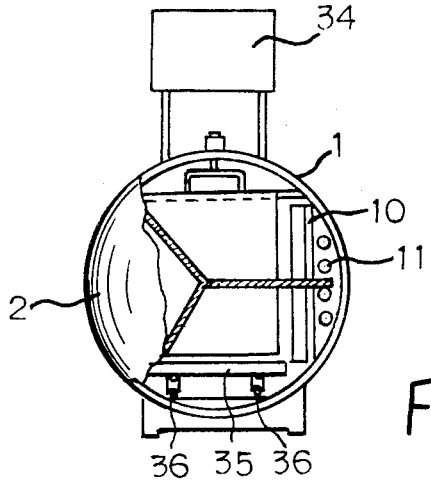
FIG. 5 is a sectional view, taken along the line 5—5 of FIG. 3.
Figure 6:
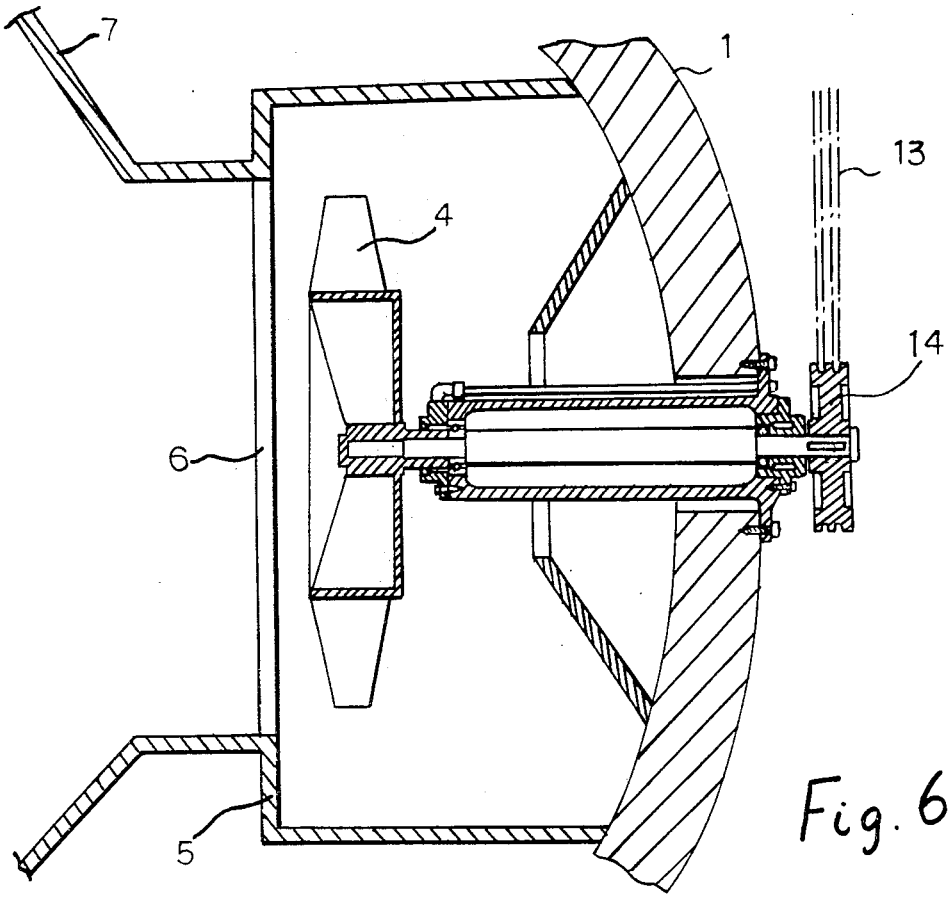
FIG. 6 is a greatly enlarged detailed vertical sectional view showing the blower means.
Figure 7:
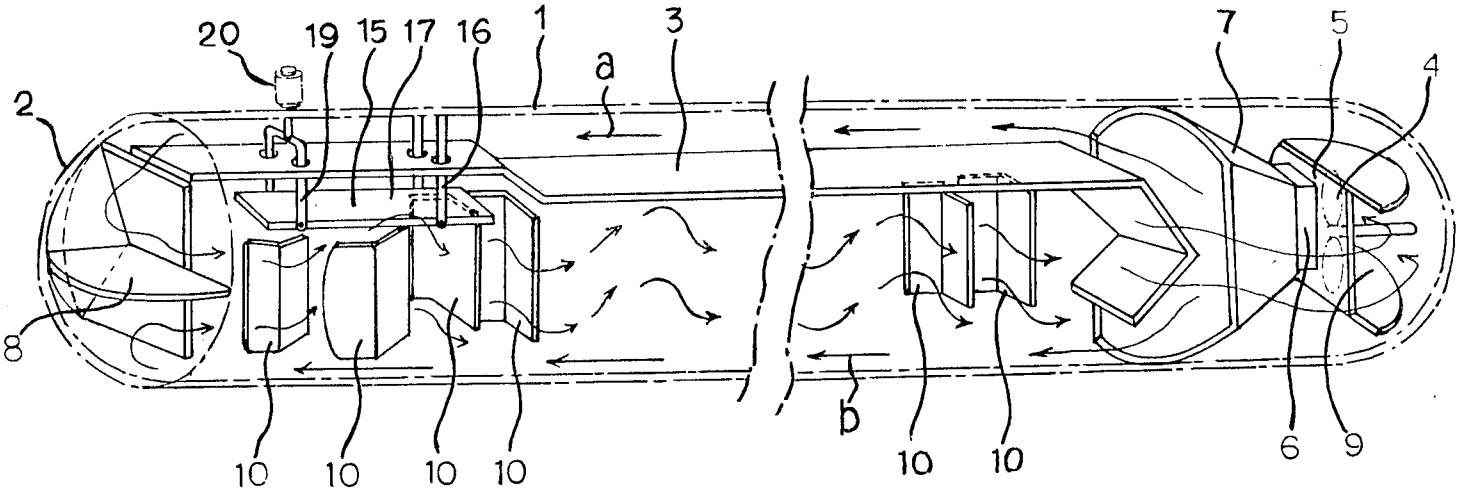
FIG. 7 is a perspective view showing hot air flows.
Figure 8A:
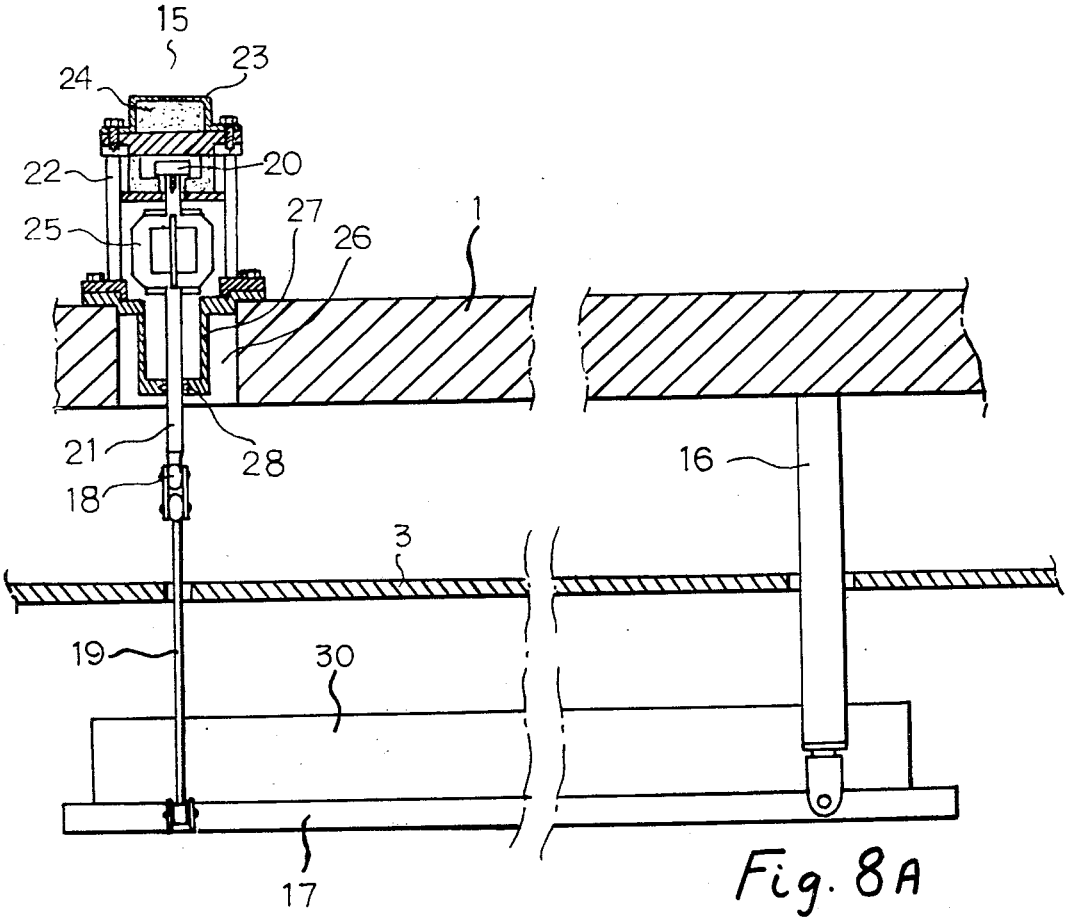
FIGS. 8A and 8B are partially detailed views of the measuring means.
Figure 8B:
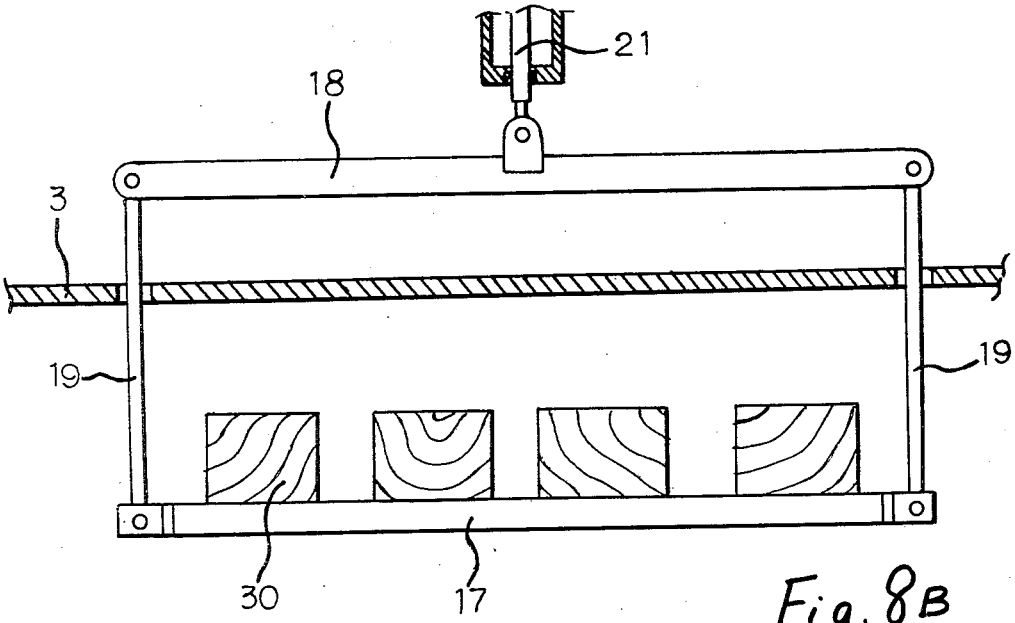

The air is collected at said door 2 by the action of a plate 8 mounted inside said door 2 towards either the right or left-hand side, e.g. the right-hand side of said door 2 in the illustrated example in FIG. 3, for the front of said door, and said air passes from the right-hand side to the left-hand side in said compartment A in FIG. 3, thereafter zigzagging from the left side to the right side alternately. Referring to FIG. 4, rectifier plates 10 are provided to cause the stream or flow of said air to be zigzag and to be stratiform in the compartment A. Said rectifier plates 10 are mounted and fixed at the right and left sides in said chamber body 1. Heating means 11 are also mounted at the right and left sides in the compartment A. Therefore, air passing through in said chamber body 1 is heated to a certain fixed temperature as it comes into contact with said heating means 11. At this time, a boiler may be employed as a heating source, the steam being heated by finned tubes mounted in said chamber body. However, the heating source may be an electric heater or any other suitable heating means for this purpose.

Hot air heated by said heating means and passed zigzag into the compartment A passes through a partially notched portion 9 of said partition plate 5 from the pre-determined side of said guide plate 7 at the closed side of said chamber body 1 and returns to the rear side of said blower 4. Said hot air will be repeatedly sent out of said window 6 by the rotary impellers of said blower, whereby the afore-mentioned streams of hot air are repeatedly circulated in said chamber body. 12 denotes an electric motor which drives said blower 4 and said electric motor is mounted on the outer surface of said chamber body 1. A drive belt is shown at 13 and a rotation pulley for said blower 4 is shown at 14. A plate and rectifier plates, which are of a fixed type, are referred to in the above description in reference to FIGS. 3 and 4. However, such plates and rectifier plates can be mounted in such conditions that they may be movable by shifting them to an optional angle or to a desired position in such conditions that they may be movable to cause the stream and flow direction of hot air to be changed.

Referring to FIGS. 2, 7, 8A and 8B, weight-measuring means is shown by 15 and is mounted at the upper portion of said compartment A of said chamber body 1. The illustrated example shows weight-measuring by sampling. Said weight-measuring means is so constructed that a pair of brackets 16 may be perpendicularly suspended and passed through said partition plate 3, one end of a plate 17 being swingably attached to said bracket 16 and the other end of said plate 17 being also swingably attached to a pair of rods 19 perpendicularly suspended from both ends of a balancing beam 18, and the central portion of said balancing beam 18 is linked with the lower end of a suspension rod 21 connected to a load cell 20 hereinafter described in detail.

At this time, said load cell 20 is accommodated by way of heat shut-off means 24 in a box means 23 supported by four supports 22 projected outwards of said chamber body 1 and the upper end of said suspension rod 21 is screwed in said load cell 20. The portion of said suspension rod 21, which is projected outside said chamber body 1, is provided with four fins 25 by which heat transmitted from the inside of said chamber body 1 by conduction is accordingly radiated. As mentioned above, said suspension rod 21 passes through an opening 26 made in said chamber body frame 1. However, a shutoff plate 27 is provided so that the atmosphere inside said chamber body may not be affected by said opening 26. An O-ring 28 is also provided to shut off the point where said suspension rod 21 passes through, whereby effective sealing is secured.

30 is a sample item of lumber placed on said plate 17. The weight change of said sample of lumber 30 is detected by electrical resistance change of said load cell 20, thereby automatically detecting the weight of material to be dried.

Referring to FIG. 4, dampening or moisturizing means is shown at 31, which supplies steam into said compartment A. An exhaust port is shown at 32 and is connected to a vacuum pump (not illustrated). This exhaust port and vacuum pump form a pressure-reducing means. A valve 33 is provided to permit said chamber body 1 to be placed at atmospheric pressure according to necessity. 34 is a balancing weight which is provided to make it easy to open or close said door in the up- and -down direction. At this time, it is a matter of course that said dampening or moisturizing means 31, said pressure-reducing means 32 and said opening valve 33 are mounted at several points in order to keep the inside conditions of said chamber body 1 free from any unevenness of dampening and/or pressure reduction where the capacity of said chamber body is made large.

Said dampening or moisturizing means 31 is employed not only to provide a steam jet for dampening and steaming during the drying process but also for humidity control, equalizing, and/or conditioning. In these cases, as warm water may be used instead of steam, a dampening means provided with a dampening unit by which a water jet is available may be employed. If such dampening means is provided, it is superior in making it easy to retain the humidity in the chamber body when carrying out the humidity control by live steam.

The method of use of an apparatus for drying lumber, disclosed by the present invention, is hereinafter described in detail. Lumber boards 29 are put on a carriage 35 which runs on rails 36 mounted at the bottom of said chamber body 1 from an opened door 2, and are carried into said chamber body 1 in its longitudinal direction. At this time, the longitudinal direction of the lumber boards placed in piles is coincident with that direction of the chamber body 1, and sleeper means 37 are set so that they may be provided in the short-distance direction of the chamber body. This is because the lumber boards may be carried into the chamber body as they are placed in piles outdoors, outside the chamber, and because good and effective flows of air are secured by making the flow of hot air coincident with the direction along which said sleeper means 37 are located. Moreover, a part of said lumber boards 29 is put on the plate 17 of the weight-measuring means 15 as a sample board 30 to suggest the weight change by change of moisture content.

Figure 9:
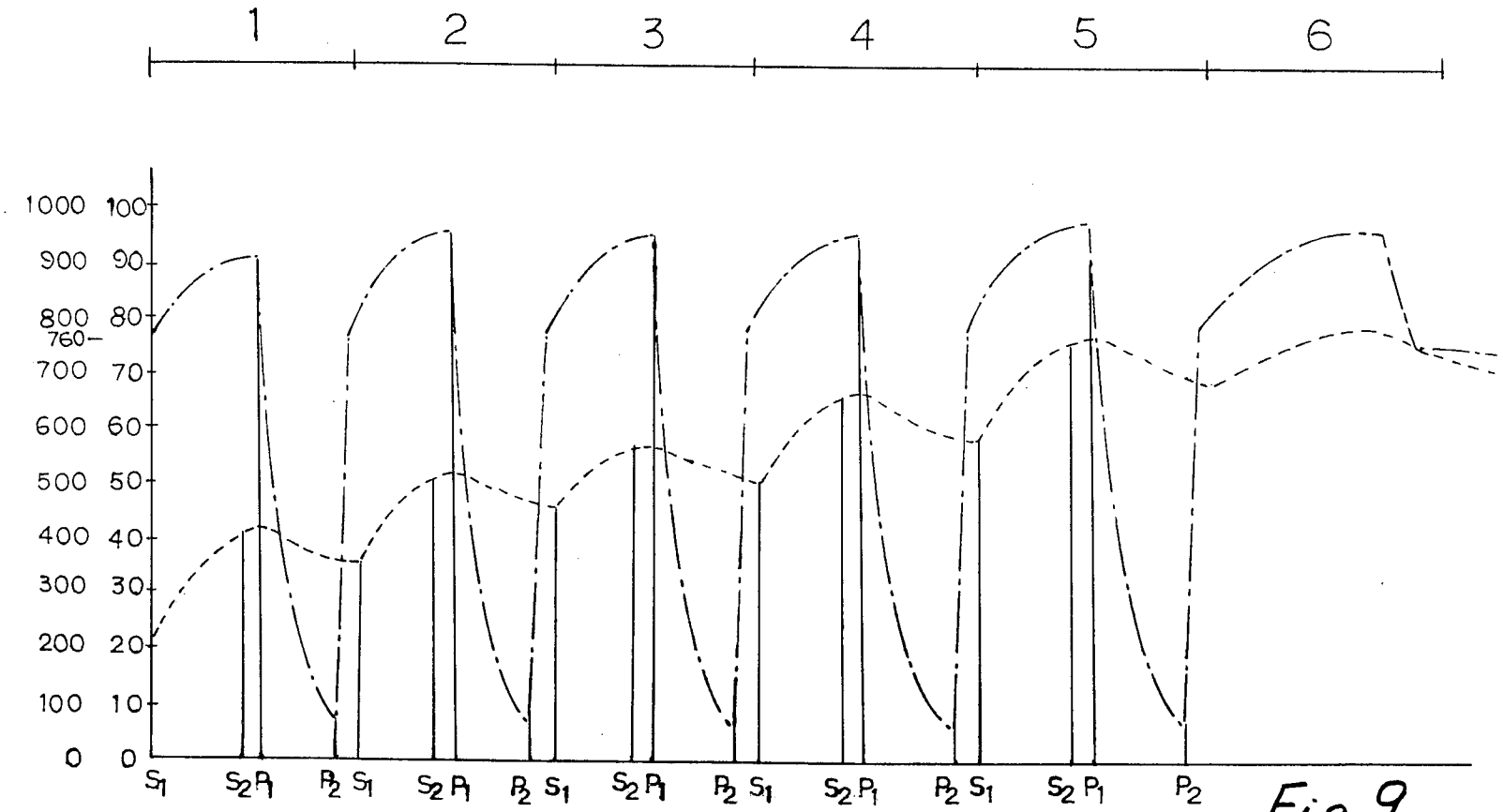
FIG. 9 is a graph illustrating treatment steps of vacuum drying.

Through the above procedures, the door 2 is then closed after the lumber boards 29 placed in piles on the carriage 35 are carried into the chamber body 1. Thereafter, the drying process is started. The weight i.e., moisture content, of the sample board 30 is determined by the weight-measuring means 15, thereby the atmospheric temperature in the whole chamber is determined. Therefore, pressure reduction, heating and dampening, which are necessary to retain the inside condition of the chamber at the conditions in compliance with said moisture content, are carried out independently, or simultaneously or in combination. FIG. 9 shows one embodiment and is an operational diagram in which lumber boards are dried so as to have 10% moisture content through six stages of control. The dotted line in FIG. 9 shows the temperature of the lumber boards to be dried, and the chain dotted line shows the pressure inside the chamber. The control procedures are described in the following:

1st Process (1st Drying)

This process is for drying lumber boards from the primary moisture content to 40% (i.e. the process in which the weight of the material to be dried is reduced from the weight A to the weight B).

(a). Atmospheric temperature—The atmospheric temperature is set to 50° C. on a dry bulb thermometer and the on-off control of a heating means is repeated until the completion signal is issued from the temperature of the lumber board.

(b). Lumber temperature—Heating is stopped when the lumber temperature reaches the value (40° C.) lower by 10° C. than the atmospheric temperature set in the above. Then, pressure reduction is started.

(c). Humidity—"ON" and "OFF" control of a dampening means is repeated till the cessation of heating, so that the temperature difference between the dry bulb and wet bulb may become 5° C. at the atmospheric temperature of 50° C.

(d). Pressure reduction—The pressure reduction is controlled in accordance with the lowered value of the lumber temperature. When the lumber temperature becomes lower by 4° C. than that of the heating stop, the pressure reduction is stopped, thereby returning the inside condition of the chamber to atmospheric pressure. Then, the weight of the lumber board is measured.

(c). Repitition—Until the weight of the lumber to be dried is reduced to the weight B, the procedures from (a) to (d) are repeated (FIG. 9 shows the case where the weight B is secured on time. In the following processes, it is also supposed that the weight B is secured in one operation.) When the signal indicating that the weight B is secured for the lumber, is issued, the 1st process is completed. Subsequently, heating will be started for the next process.

2nd Process (2nd Drying)

This process is for drying the lumber boards so that the moisture content may become 30% (i.e. the process in which the weight of the lumber boards is reduced from the weight B to the weight C).

(a). Atmospheric temperature—The atmospheric temperature is set to 60° C. on a dry bulb thermometer and the on-off control of heating means is repeated until the completion signal is issued from the temperature of the lumber boards.

(b). Lumber temperature—Heating is stopped when the lumber temperature reaches the value (50° C.) lower by 10° C. than the atmospheric temperature set in the above. The pressure reduction is then started.

(c). Humidity—"ON" and "OFF" control of a dampening means is repeated until the cessation of heating, so that the temperature difference between the dry bulb and wet bulb may become 7° C. at the atmospheric temperature of 60° C.

(d). Pressure reduction—The pressure reduction is controlled in accordance with the lowered value of the lumber temperature. When the lumber temperature becomes lower by 4° C. than that on the heating stop, the pressure reduction is stopped, thereby returning the inside condition of the chamber to atmospheric pressure. Then, the weight of lumber board is measured.

(e). Repetition—Until the weight of the lumber to be dried is reduced to the weight C, the procedures from (a) to (d) are repeated. When the signal indicating that the weight C is secured at the lumber weight, is issued, the 2nd process is completed. Subsequently, heating is started for the next process.

3rd Process (3rd Drying)

This process is for drying the lumber boards so that the moisture content may become 20% (i.e. the process where the weight of the lumber boards is reduced from the weight C to the weight D).

(a). Atmospheric temperature—The atmospheric temperature is set to 65° C. on a dry bulb thermometer and the on-off control of heating means is repeated until the completion signal is issued from the temperature of the lumber boards.

(b). Lumber temperature—Heating is stopped when the lumber temperature reaches the value (55° C.) lower by 10° C. than the atmospheric temperature set in the above. The pressure reduction is then started.

(c). Humidity (moisture)—"ON" and "OFF" control of a dampening means is repeated until the cessation of heating so that the temperature difference between the dry bulb and wet bulb may become 10° C. at the atmospheric temperature of 65° C.

(d). Pressure reduction—The pressure reduction is controlled in accordance with the lowered value of the lumber temperature. When the lumber temperature becomes lower by 4° C. than that on the heating stop, thereby returning the inside condition of the chamber to the atmospheric pressure, the weight of the lumber boards is measured.

(e). Repetition—Until the weight of the lumber to be dried is reduced to the weight D, the procedures from (a) to (d) are repeated. When the signal indicating that the weight D is secured at the lumber weight, is issued, the 3rd process is completed. Subsequently, heating is started for the next process.

4th Process (4th Drying)

This process is for drying the lumber boards so that the moisture content may become 15% (i.e. the process where the weight of the lumber boards is reduced from the weight D to the weight E).

(a). Atmospheric temperature—The atmospheric temperature is set to 70° C. on a dry bulb thermometer and the on-off control of heating means is repeated until the completion signal is issued from the temperature of the lumber boards.

(b). Lumber temperature—Heating is stopped when the lumber temperature reaches the value (65° C.) lower by 5° C. than the atmospheric temperature set in the above. The pressure reduction is then started.

(c). Humidity—"ON" and "OFF" control of a dampening means is repeated until the cessation of heating so that the temperature difference between the dry bulb and wet bulb may become 15° C. at the atmospheric temperature 70° C.

(d). Pressure reduction—The pressure reduction is controlled in accordance with the lowered value of the lumber temperature. When the lumber temperature becomes lower by 4° C. than that on the heating stop, thereby returning the inside condition of the chamber to the atmospheric pressure, the weight of the lumber boards is then measured.

(e). Repetition—Until the weight of the lumber to be dried is reduced to the weight E, the procedures from (a) to (d) are repeated. When the signal indicating that the weight F is secured at the lumber weight, is issued, the 4th process is completed. Subsequently, heating is started for the next process.

5th Process (5th Drying)

This process is for drying the lumber boards so that the moisture content may become 8% (the process where the weight of the lumber boards is reduced from the weight E to the weight F.)

(a). Atmospheric temperature—The atmospheric temperature is set to 80° C. on a dry bulb thermometer and is kept on this value 80° C. for 2 hours at the maximum by setting the timer.

(b). Lumber temperature—No regard in this process (c). Humidity—"ON" and "OFF" control of a dampening means is repeated until the cessation of heating so that the temperature difference between the dry bulb and wet bulb may become 20° C. at the atmospheric temperature 80° C.

(d). Pressure reduction—The pressure-reduced condition is kept by setting the timer for 1 hour and a half at the maximum.

(e). Repetition—Until the weight of the lumber to be dried is reduced to the weight F, the procedures from (a) to (d) are repeated. When the signal indicating that the weight F is secured at the lumber weight, is issued, the 5th process is then completed. Subsequently, heating is started for the next process.

6th Process (6th Drying)

This process is for seasoning and/or conditioning the lumber boards so that the moisture content may become 10% (at this time, the weight of the lumber boards may become the weight G).

(a). Atmospheric temperature—The atmospheric temperature is set to 80° C. on the dry bulb thermometer and this atmospheric temperature is kept for about 6 hours.

(b). Humidity—"ON" and "OFF" control of a dampening means is repeated till stop of heating so that the temperature difference between the dry bulb and the wet bulb may become 5° C. at the atmospheric temperature 80° C.

Figure 10:
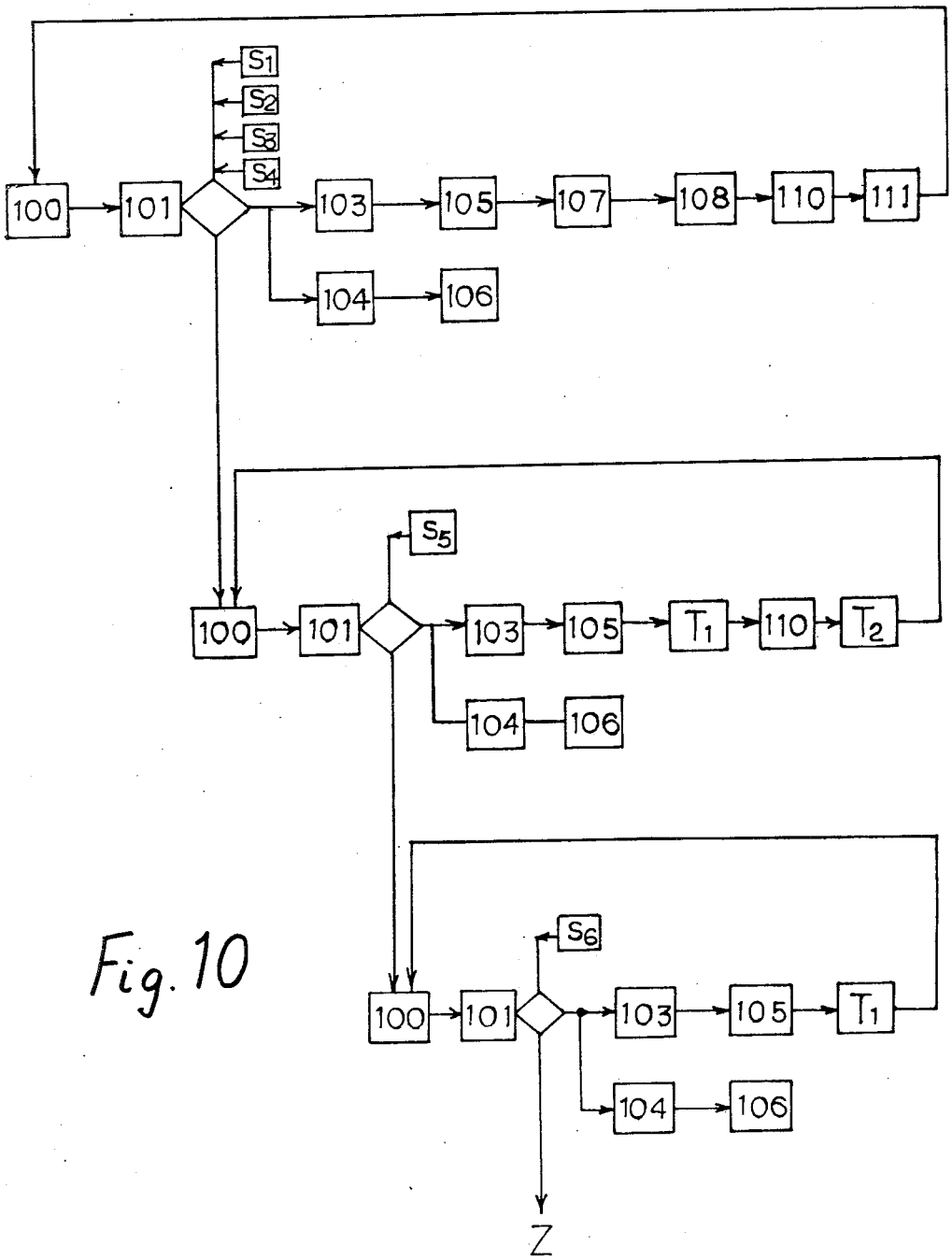
FIG. 10 is a simplified flow sheet showing the sequences of automatic control.

The above control procedures show the case where the inside pressure of the chamber rises as the atmospheric temperature rises. However, the inside pressure of the chamber may be controlled to be less than the atmospheric pressure by operating said opening valve 33. On practical measurement example of lumber temperature is to detect the temperature by the change of electric resistance of a temperature-measuring resistor placed in a hole made in the material (lumber board). In case the drying degree is made clear as a result of repeated drying operations of the same materials, the control procedures may not depend upon the temperature of the lumber boards to be dried but may depend upon setting the timer. Therefore, the time of heating and of pressure reducing may be determined by a timer. There is a need to make great temperature differences between the dry and wet bulbs in the chamber as the drying degree advances. To secure such a great temperature difference between the dry and wet bulbs, it is effective to compulsorily ventilate the inside of the chamber, during the heating process, while the lumber temperature rises, with air from outside that system, by such compulsory ventilation means as another blower provided separately. The automatic control of the above-mentioned operations is performed by a control box 40 mounted at any convenient place next to said chamber body 1. FIG. 10 shows the flow sheet of the automatic control explaining the above six processes. In that figure, 100 is a weight-measuring means. 101, 105, 106, 108 and 111 are controllers. 103 is an indicator of the atmospheric temperature. 104 is also an indicator of the atmospheric humidity. 107 is an indicator of the lumber temperature. 110 is an indicator of the atmospheric pressure. T1 and T2 are timers. S1, S2, S3, S4, S5, and S6 are the drying process. And Z shows the removal of the dried and conditioned lumber boards.

First of all, the weight A of lumber boards to be dried is checked from the sample lumber placed on said weight-measuring means in the chamber. Therefore, as the moisture content of said lumber boards is made clear from the weight A and the plan table made in advance, the primary moisture content is then memorized in the automatic control device. After the above preparation is completed, the apparatus is started for drying said lumber boards.

The signal of a transmitter of the primary moisture content of said lumber is controlled by said controller 101 in comparison with the weight signal of lumber to be dried and a steam valve for heating is then operated, thereby starting the heating of the lumber boards. At this time, the lumber boards may be heated with the opening valve 33 of the chamber opened.

On the other hand, the blower 4 of the chamber is started, and hot air is circulated in the course mentioned above. The heating condition is indicated by the temperature indicator 103. During heating , the dampening means 31 is actuated to keep the necessary humidity in the chamber together with heating. At this time, the humidity is confirmed by the humidity indicator 104 and the operation is continued by checking the lumber temperature by the lumber temperature indicator 107 until the lumber temperature reaches the predetermined value $t_1$° C. (i.e., lower by 10° C. than the atmospheric temperature in the 1st process) as the desired atmospheric condition in the chamber for temperature and humidity is retained by the controllers 105 and 106. When the lumber reaches the predetermined value $t_1$° C. through heating, the controller 108 operates to stop the heating and dampening. The pressure-measuring means is then started, thereby placing the inside condition of the chamber at negative pressure. The pressure reducing means is operated by confirming the negative pressure level by a pressure gauge (indicator) 110 until the lumber temperature becomes the predetermined temperature $t_2$° C. (i.e., a value lower by 4° C. than $t_1$° C. in the 1st process). When the predetermined lumber temperature $t_2$° C. is secured, the inside condition of the chamber is once again restored to the atmospheric pressure by actuation of the controller 111. The weight of said lumber is then measured. If the indication signal of the memorized moisture content of lumber is not consistent with the measurement signal obtained by the above measurement when comparing them with each other, the above process is repeated to secure consistency between these signals. Through these procedures, the weight A of said lumber is reduced by drying to the predetermined weight B. The 1st process (1st drying term) (S1) is then completed.

At this time, a signal may be issued to open the opening valve for introducing atmospheric air into the chamber when necessary after the temperature inside the chamber reaches the predetermined lumber temperature $t_1$° C. After that, said opening valve is closed and the pressure-reducing means is then started. A signal may still be issued to open the opening valve as well, if necessary, when restoring the inside condition of the chamber to atmospheric pressure on the lumber temperature $t_2$° C. After that, said opening valve is closed and the heating means is then operated.

When the weight of said lumber is reduced from the weight A to the weight B as shown above, the process is shifted to the 2nd process (S2) from the 1st process (S1) by an electronic computer unit (not illustrated).

All the operations of the 2nd process (S2) are the same as those of the 1st process, excepting that the prescribed values of temperature and humidity are different from those in the 1st process. Through those operations, the weight of said lumber is reduced from the weight B to the weight C.

Basically, the signal 100 issued from the weight measuring means and the signal of the transmitter for the moisture content of said lumber are controlled in comparison by the controller 101 and the steam valve is again opened for heating in the 2nd process and heating is then started. As shown in the above, the lumber boards which are finally dried to have the desired moisture content will be automatically obtained by repeating the same operations as shown above in phased programs.

In the 5th process (S5) and the 6th process (S6) in the preferred embodiment described herein, no control signals are issued from the lumber temperature but they are taken from the timers. The signal from the weight-measuring means 100 and the signal from the transmitter for the moisture content of the lumber are controlled in comparison by the controller 101. The heating phase in the 5th process is then started. Heating and dampening to keep the inside condition of the chamber are controlled and carried out in the same manner as that in the 1st process. Howver, the heating means and the dampening means are stopped by the signal issued from the timer (T1) after the prescribed time has elapsed and the pressure-reducing means is then operated. The pressure-reducing means is controlled by the timer (T2), the pressure-reducing phase being automatically completed after the set time has elapsed. Subsequently, the weight of the lumber is measured after restoring the inside condition of the chamber to atmospheric pressure. If the lumber does not reach the prescribed drying degree, the above operation is again repeated.

For the 6th (S6), there may be carried out the same operation and run as those in the 5th process. This process does not include the pressure-reducing operation as a matter of course.

The blower 2, which is mounted at the completely closed side of the chamber body 1 in the apparatus disclosed by the present invention and by which hot air may be flowed in one direction, is described in the above description and shown in the drawings. However, the flow direction may be made the reverse or may be alternately changed. To facilitate reversing or alternately changing the flow direction of the hot air, optionally another blower(s) may be provided in a suitable place in the chamber. If the flow direction of hot air is changed alternately, any dead spaces in the flow, which may be caused by the shape of the material to be dried, may be eliminated, thereby uniform heating being effectively secured. The chamber body and the materials to be dried, which are of a stationary type, are shown herein. However, they may also be of a swingable or rotary type. The weight-measuring means which measures the weight of a part of the materials to be dried as a sample is illustrated in the accompanying drawings. However, a weight-measuring means which can measure the total weight of the material may also be employed. Furthermore, one may utilize the average value, which is obtained by measuring several samples as unit, in the weight measurement.

The drying method and apparatus disclosed by the present invention does not require any experience and/or skill to operate it since the atmospheric temperature inside the chamber is determined by confirming the moisture content, i.e. the drying degree of the materials to be dried by measuring their weight as they are in the chamber, whereby efficient and effective work is carried out by full-automatic operation.

A moisture content measuring means may be used instead of said weight-measuring means in the above embodiment. Namely, in the case of an electric resistance type moisture content gauge in which the principle is used that the direct current resistance of lumber is considerably changed by the degree of moisture content is employed, the moisture content (i.e. drying degree) can be easily confirmed by directly applying an electrode to the lumber to be dried. Therefore, if said electrode signal (the moisture content of the lumber) is used as input, the fully-automatic control and running of the drying apparatus can be exercised as shown in the above embodiments.

It brings excellent effect and action to the uniform drying of the material to be dried, that the heating means for the hot air are mounted at both the right and left hand sides in the longitudinal direction of the chamber 1, and said hot air is caused to flow zigzag in the cross direction of said chamber. Moreover, as the sleeper means 37 are directly utilized as means to produce stratiform flows of hot air, there is no need to make many air-passing holes in the sleeper means as shown in the conventional drying methods and apparatuses. This is also superior at the point where the lumber boards can be placed on the carriage means 35 as they are placed in piles in the field but the conventional method and apparatuses require the replacement of lumber boards for placing them on the carriage means. Further, as the chamber body construction disclosed by the present invention has an indirect heating system and not a direct heating type, there is no need to make double structures such as outer and inner structures.

The diameter of the chamber can therefore be made smaller than that of the conventional apparatuses and the whole apparatus disclosed by the present invention can be made compact when compared with other conventional equipments, whereby the accommodation capacity is much increased even if a small capacity is employed. Furthermore, as the effect of the automatic control running including the seasoning of lumber boards is the same as that of natural drying in open air, the object of drying lumber boards is efficiently and effectively accomplished without any physical and chemical changes.

The following description refers to another embodiment disclosed by the present invention. This embodiment deals with insect-proofing, the rot-proofing, coloring and other necessary treatments of lumber boards in addition to the drying process described in the former embodiment.

Figure 11:
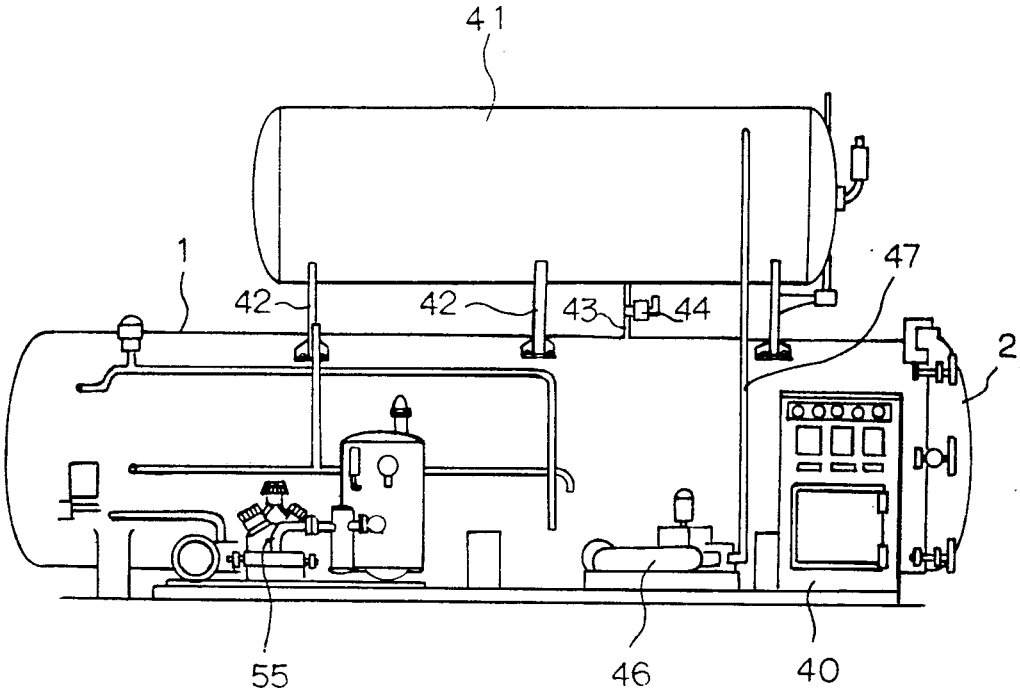
FIGS. 11 and 12, show another embodiment also disclosed by the present invention, FIG. 11 being a side view of the whole system according to said embodiment, FIG. 12 being a semi-diagrammatical sectional view of the operation of said embodiment, and FIG. 13 being a semi-diagrammatical sectional view of yet another embodiment.
Figure 12:
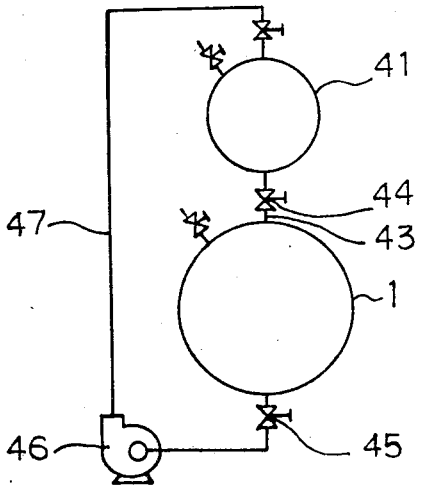

FIG. 11 is a front elevational view of the whole system, also disclosed by the present invention, in which 41 is a chemical solution tank mounted on said chamber body 1 via support means 42. Said chemical solution tank 41 is linked with the chamber body 1 by piping means 43, and a valve 44 is provided in the piping means 43 on the way to the chamber body 1. The inside structure of the chamber body is the same as that of the former embodiment, excepting that ejection nozzles and discharge pipes for said chemical solution are arranged inside the chamber body.

For example, a reinforcement treatment such as P. E. G. (polyethylene glycol) treatment to prevent lumber boards from being split or cracked can be carried out in the above embodiment. The following description is limited to this treatment. Said P.E.G. treatment is carried out when the lumber boards reach the desired moisture content during the drying process. Said valve 44 is opened with the inside pressure of the chamber 1 reduced, and the P.E.G. solution is introduced into the chamber 1 from the chemical solution tank 41. Said P.E.G. solution is then sprayed or ejected toward the lumber boards through the nozzles. Said P.E.G. solution may alternatively be directly discharged into the chamber 1 through the discharge pipes so that the lumber boards may be completely saturated or immersed in said solution. After this condition is retained for some time, the inside condition of the chamber is gradually returned to the atmospheric pressure. At this time, the chamber may be still pressuresed above atmospheric pressure or said treatment may be repeated according to the kinds of lumber boards to be treated. After said treatment is completed as shown in the above, the polyethylene glycol solution which is left in the chamber is again returned into the chemical solution tank 41 by a pump 46 through an outlet valve 45 and the piping means 47. It is desirable that said P.E.G. treatment is carried out at a suitable stage from the 2nd process to the 4th process in the former embodiment.

The following explanation deals with rot-proofing treatment. It is desirable that this rot-proofing treatment is carried out when the lumber reaches the moisture content (approx. 20 to 25%) in the proximity of the saturation point of fiber. As shown in the former P.E.G. treatment, a rot-proofing solution, with the inside pressure of the chamber reduced, is ejected or sprayed in the chamber through the nozzle from the chemical solution tank, or is discharged into the chamber from the discharge pipe so that the lumber boards may be completely immersed. As well as the case of the P.E.G. treatment, the solution left in the chamber is again returned to the tank by the pump through the outlet valve. Other insect-proofing, mold-proofing, fire-resisting and coloring treatments can be carried out as well as the above two examples. Where each of the above treatments is carried out in the embodiments disclosed by the present invention with the inside pressure of the chamber reduced, the permeation effect of each chemical solution is remarkably promoted. However, each treatment may be of course carried out after all the drying processes are completed. And it may be also performed with the inside condition of the chamber retained or kept at atmospheric pressure. These methods of carrying out the treatments are selected or chosen according to the purpose or kind of the lumber treatments, and the grade or finish degree of the lumber boards. Only a chemical solution tank 1 is provided in FIG. 11, which can supply only a chemical solution and into which the solution left in the chamber after the treatment is returned. A plurality of chemical solution tanks can be mounted on the chamber in series, whereby various treatments may be performed one after another. At this time, solenoid valves are used to supply each chemical solution, the valves being automatically opened and/or closed by electrical signals. It is needless to say that the drying treatment and each treatment aforementioned can be automatically performed simultaneously or in combination at a suitable stage during the former drying processes. This embodiment refers to the system in which the used chemical solution is collected or returned into the tank. However, such used solution may be abolished if no pollution is caused.

Furthermore, several treatment can be simultaneously carried out by spraying different kinds of chemical solutions through several different nozzles.

Figure 13:
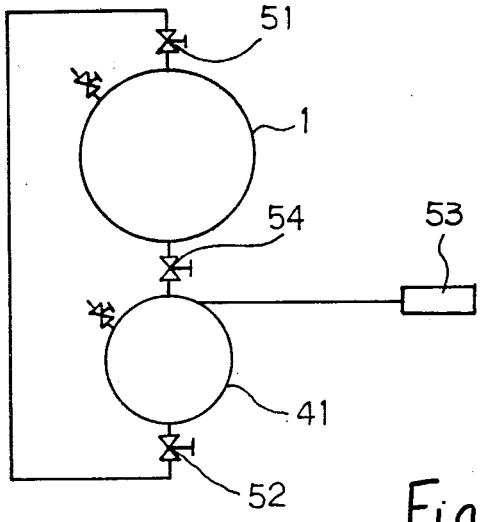

The above embodiment shows the system in which a chemical solution tank 41 is mounted on the chamber body 1. FIG. 13 shows another example where the chemical solution tank is mounted below the chamber body. In this case, the valves 51 and 52 are opened when a chemical solution is supplied into the chamber body 1 and the chemical solution tank 41 is compressed by a compressor 53, the chemical solution being poured under compression into the chamber body 1. After the specified treatment is completed, another valve 54 is opened, and the chemical solution left in the chamber body 1 is returned into the tank 41 by gravity.

When the pressure-reducing process is started after the lumber is saturated or immersed in the chemical solution, there is no need to remove the whole of the air in the chamber and the chemical solution will be rapidly absorbed in the lumber during the stage where the reduced pressure is restored to normal pressure. However, compression is desirable for particular kinds of lumber.

For this purpose, a compressor may be separately provided, which is shown at 55 in FIG. 11.

The above description is limited only to lumber materials. However, the method and apparatus disclosed by the present invention is effective for cereals, agricultural products and for earthenwares.

Although the present invention has been described in detail and with reference to specific embodiments thereof, various changes and modifications can be made therein by one skilled in the art without departing from the spirit and scope thereof as defined by the appended claims.

I claim:

1. The method of drying a material, utilizing an apparatus which includes a sealable enclosure to receive the material, means for heating the atmosphere within the enclosure, means for reducing the pressure of the atmosphere within the enclosure, means for dampening the contents of the enclosure, and means within the enclosure for ascertaining the moisture content of a sample of the material, said method comprising the steps of:

(i) introducing material into the enclosure, (ii) ascertaining the moisture content of a sample of the material in the enclosure, (iii) operating the heating means to heat the atmosphere within the enclosure to a predetermined temperature (iv) simultaneously with the heating of the contents of the enclosure, operating the dampening means to achieve a predetermined moisture content in the atmosphere within the enclosure at said predetermined temperature (v) determining when the temperature of the material has reached a selected temperature lower than said predetermined temperature, and causing the heating to be stopped when said selected temperature has been reached (vi) thereafter operating the pressure-reducing means for a period during which the temperature of the material becomes reduced by a selected value, and thereafter permitting the pressure within the enclosure to return to external atmospheric pressure (vii) thereafter again ascertaining the moisture content of the sample of material to obtain a new moisture content value for comparison with the moisture content value obtained in step (ii) above, the sequence of steps (1) through (vii) being repeated a number of times until the moisture content value obtained by step (vii) of the last repetition represents a desired moisture content of the dried material.

2. The method claimed in claim 1, wherein step (ii) is carried out by weighing the sample.

3. The method claimed in claim 1 wherein the step of heating the material in the enclosure includes passing heated air in a zig-zag path over the material in the enclosure.

4. The method claimed in claim 1, comprising continuously monitoring the moisture content of the sample of material within the enclosure so as to continuously detect change of the degree of drying of the sample, and utilizing the detected change of degree of drying to control further carrying out of the sequence of steps (i) to (vii).

5. The method claimed in claim 1, comprising the further step of treating the material for insect-proofing, rot-proofing or colour, or any combination thereof, during the sequence of steps (i) to (vii).

6. Apparatus, for drying material, comprising:

(a) a sealable enclosure to receive the material (b) means within the enclosure for ascertaining the moisture content of a sample of the material therein (c) means for heating the atmosphere within the enclosure (d) means for dampening the contents of the enclosure (e) means for reducing the pressure of the atmosphere in the enclosure to below external atmospheric pressure (f) means for controlling the operation of said heating means, dampening means, and pressure-reducing means, said controlling means being adapted to compare the moisture content recorded by said moisture content ascertaining means and to compare that recorded moisture content with a predetermined moisture content value, and to cause repeated operation of the said heating means, dampening means, and pressure-reducing means until a predetermined overall reduction of moisture content has been achieved in a sample.

7. An apparatus, as claimed in claim 6, wherein said moisture content ascertaining means is an electrical resistance moisture content meter.

8. An apparatus, as claimed in claim 6, further comprising tank means disposed in proximity to said enclosure to contain liquid for insect-proofing, rot-proofing, or colouring the material, or any combination thereof, and means communicating with said tank means and serving for introduction of said liquid into the enclosure.

9. An apparatus, as claimed in claim 8, wherein said tank means comprises a plurality of tanks for respective treatment liquids.

* * * * *